US009640905B2

(12) United States Patent
Suzuki

(10) Patent No.: US 9,640,905 B2
(45) Date of Patent: May 2, 2017

(54) CONNECTOR

(71) Applicant: Sumitomo Wiring Systems, Ltd., Yokkaichi, Mie (JP)

(72) Inventor: Masakazu Suzuki, Mie (JP)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 14/902,601

(22) PCT Filed: Jun. 30, 2014

(86) PCT No.: PCT/JP2014/067360
§ 371 (c)(1),
(2) Date: Jan. 4, 2016

(87) PCT Pub. No.: WO2015/008608
PCT Pub. Date: Jan. 22, 2015

(65) Prior Publication Data

US 2016/0197440 A1 Jul. 7, 2016

(30) Foreign Application Priority Data

Jul. 16, 2013 (JP) ..... 2013-147658

(51) Int. Cl.
*H01R 13/64* (2006.01)
*H01R 13/627* (2006.01)
(Continued)

(52) U.S. Cl.
CPC ..... *H01R 13/6271* (2013.01); *H01R 13/4364* (2013.01); *H01R 13/64* (2013.01);
(Continued)

(58) Field of Classification Search
CPC ..... H01R 13/4223; H01R 13/4226; H01R 13/4362
(Continued)

(56) References Cited

U.S. PATENT DOCUMENTS 5,664,966 A * 9/1997 Maegawa ..... H01R 13/4364 439/595
5,713,761 A * 2/1998 Okayasu ..... H01R 13/5219 439/271
(Continued)

FOREIGN PATENT DOCUMENTS

JP 2002-313474 10/2002
JP 2010-238514 10/2010
(Continued)

OTHER PUBLICATIONS

International Search Report.

*Primary Examiner* — Tho D Ta
*Assistant Examiner* — Marcus Harcum
(74) *Attorney, Agent, or Firm* — Gerald E. Hespos; Michael J. Porco; Matthew T. Hespos

(57) ABSTRACT

A first housing (10) of a connector includes a housing main body (11) with a receiving portion (17) and a tubular member (20) surrounding the housing main body (11). A peripheral wall (22) of the tubular member (20) has a resilient lock (24) configured to deflect resiliently out when assembling the tubular member (20) and the housing main body (11) and to return resiliently to lock with the receiving portion (17) when the tubular member (20) is assembled properly with the housing main body (11). A protrusion (31) is formed on the outer periphery of the resilient locking portion (24) and is configured to interfere with a receptacle (61) while fitting the tubular member (20) into the receptacle (61) so that an improperly assembled tubular member (20) is corrected into a properly assembled state.

16 Claims, 9 Drawing Sheets

(51) Int. Cl.

| | |
|---|---|
| ***H01R 13/645*** | (2006.01) |
| *H01R 13/422* | (2006.01) |
| *H01R 13/436* | (2006.01) |
| *H01R 13/52* | (2006.01) |

(52) U.S. Cl.
CPC ..... *H01R 13/645* (2013.01); *H01R 13/4223* (2013.01); *H01R 13/4226* (2013.01); *H01R 13/4362* (2013.01); *H01R 13/5219* (2013.01)

(58) Field of Classification Search
USPC ..... 439/752
See application file for complete search history.

(56) References Cited

U.S. PATENT DOCUMENTS

| | | | | | |
|---|---|---|---|---|---|
| 5,816,856 | A * | 10/1998 | Kamath | H01R 13/4365 | 439/595 |
| 5,941,737 | A * | 8/1999 | Sakai | H01R 13/4223 | 439/752 |
| 6,827,609 | B1 * | 12/2004 | Martin | H01R 13/4365 | 439/595 |
| 6,863,568 | B2 * | 3/2005 | Nakamura | H01R 13/4364 | 439/595 |
| 7,114,997 | B2 * | 10/2006 | Sagawa | H01R 13/4365 | 439/595 |
| 2007/0224888 | A1 * | 9/2007 | Tyler | H01R 13/4365 | 439/752 |
| 2008/0009201 | A1 * | 1/2008 | Hiramatsu | H01R 13/4365 | 439/752 |
| 2009/0081908 | A1 * | 3/2009 | Martin | H01R 13/4223 | 439/752 |
| 2009/0280696 | A1 * | 11/2009 | Brown | H01R 13/4223 | 439/719 |
| 2014/0127928 | A1 * | 5/2014 | Kida | H01R 13/4223 | 439/345 |

FOREIGN PATENT DOCUMENTS

| | | |
|---|---|---|
| JP | 2011-119103 | 6/2011 |
| JP | 2012-43649 | 3/2012 |
| JP | 2012-252875 | 12/2012 |

* cited by examiner

CONNECTOR

BACKGROUND

1. Field of the Invention

The present invention relates to a connector.

2. Description of the Related Art

Japanese Unexamined Patent Publication No. 2012-043649 discloses a connector with a female first housing and a male second housing including a fitting tube portion. The first housing includes a terminal accommodating tube portion for accommodating terminal fittings and a tubular front holder surrounding the terminal accommodating tube portion. The front holder is mounted onto the terminal accommodating tube portion from front. The front holder has a function of retaining the terminal fittings and other functions.

As a means for locking the front holder in a state mounted on the terminal accommodating tube portion, it is considered to form a resilient locking portion resiliently deflectable toward an outer peripheral side on a peripheral wall portion constituting the front holder and lock this resilient locking portion to a receiving portion on the outer periphery of the terminal accommodating tube portion. In this locking structure, the resilient locking portion is resiliently deflected to project toward the outer peripheral side of the peripheral wall portion by interfering with the outer periphery of the terminal accommodating tube portion in the process of mounting the front holder onto the terminal accommodating tube portion. When the front holder is properly mounted on the terminal accommodating tube portion, the resilient locking portion resiliently returns toward an inner peripheral side to be locked to the receiving portion.

The terminal accommodating tube portion having the front holder mounted thereon in this way is fitted into the fitting tube portion of the second housing. A clearance is secured between the outer periphery of the front holder and the inner periphery of the fitting tube portion in consideration of dimensional tolerances so that a connecting operation smoothly proceeds. Thus, the terminal accommodating tube portion may be accommodated into the fitting tube portion despite an incompletely connected state where a part of the resilient locking portion is protruding from the outer periphery of the peripheral wall portion of the front holder without the front holder reaching a proper mount position.

The present invention was completed based on the above situation and aims to prevent improper assembling.

SUMMARY

The present invention is directed to a connector with a female first housing that includes a housing main body configured to accommodate a terminal fitting and a tubular member to be assembled to surround the housing main body. The connector further includes a male second housing with a receptacle formed that can fit to and surround the housing main body and the tubular member in an assembled state. A receiving portion is formed on an outer periphery of the housing main body, and a resilient lock is formed on a peripheral wall of the tubular member. The resilient lock is configured to interfere with the outer periphery of the housing main body in the process of assembling the tubular member with the housing main body and to deflect resiliently out. The resilient lock then returns resiliently toward an inner peripheral side to be locked to the receiving portion with the tubular member properly assembled with the housing main body. A protrusion is formed on an outer periphery of the resilient lock and is configured to correct the tubular member into a properly assembled state by interfering with the receptacle in the process of fitting the tubular member and the housing main body left in an improperly assembled state into the receptacle.

According to this configuration, the protrusion on the outer periphery of the resilient lock corrects the position of the tubular member to attain the properly assembled state by interfering with the receptacle in the process of fitting the tubular member and the housing main body left in the improperly assembled state into the receptacle. Thus, the connection of the first and second housings with the tubular member and the housing main body left in the improperly assembled state can be avoided.

The protrusion may be in contact with an inner periphery of the receptacle while being pressed with the properly assembled housing main body and tubular member fitted in the receptacle, thereby regulating relative displacements of the first and second housings. Accordingly, the protrusion for correcting improper assembling of the tubular member and the housing main body also functions as a backlash preventing means for regulating relative displacements of the first and second housings. Thus, the shape of the first housing can be simplified as compared to the case where a backlash preventing means for regulating relative displacements of the first and second housings is provided in addition to the protrusion.

An area of the resilient lock opposite the protrusion may be in contact with the outer periphery of the housing main body when the first and second housings are connected. According to this configuration, relative displacements of the first and second housings are prevented reliably since the resilient lock and the protrusion are sandwiched between the housing main body and the receptacle.

The connector may be configured so that a surface of the protrusion facing the receptacle is in surface contact with the inner periphery of the receptacle when the properly assembled housing main body and tubular member are fit in the receptacle. This configuration prevents improper deformation of the protrusion and the receptacle.

The resilient lock may be deflectable resiliently about a support, and the protrusion may be formed at the support. Thus, the position correcting function of the protrusion is very reliable since the position of the protrusion is unlikely to vary.

DETAILED DESCRIPTION

Figure 1:
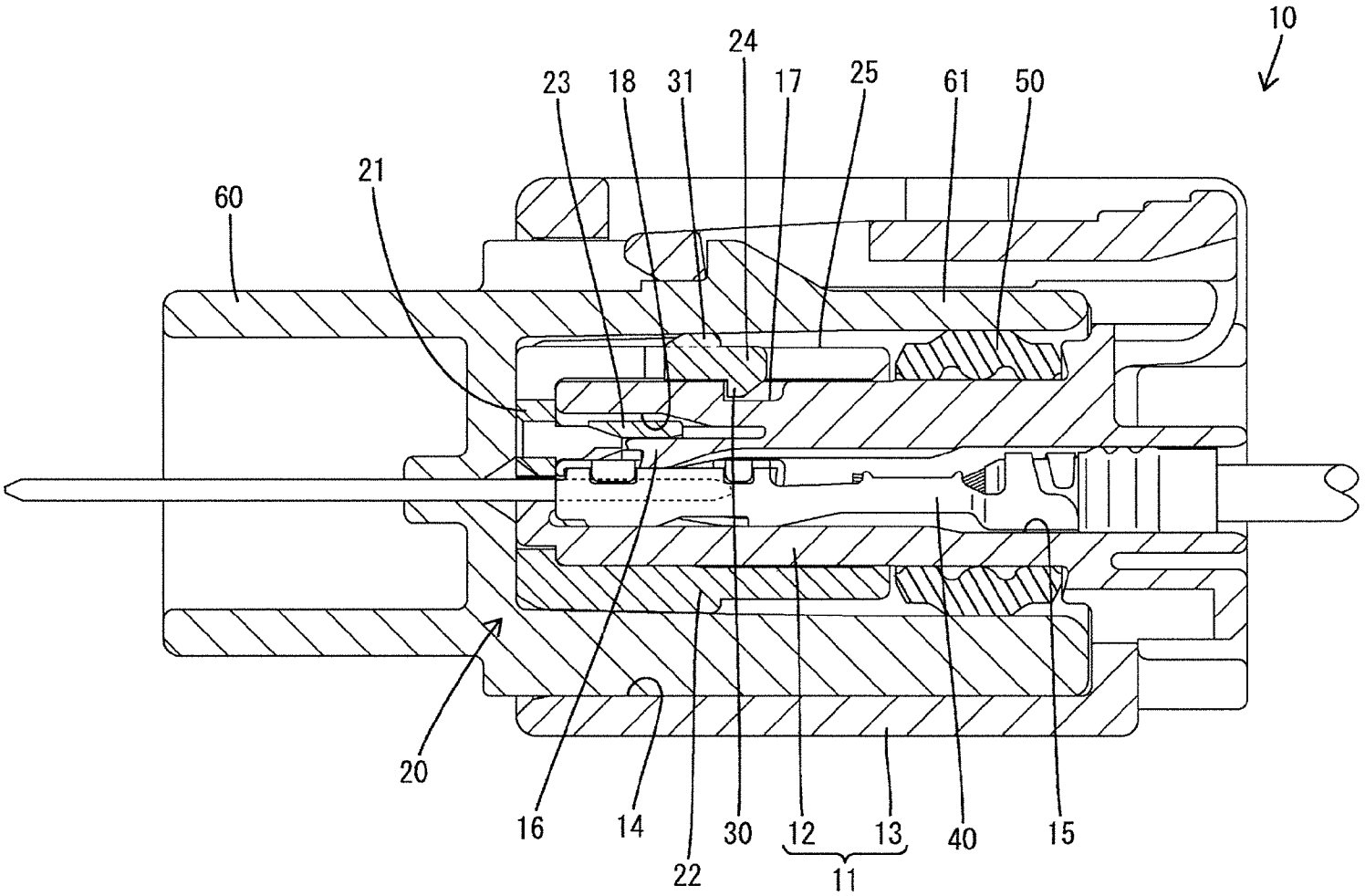
FIG. 1 is a section showing a state where a first housing and a second housing are properly connected in a connector of one embodiment.

Hereinafter, one specific embodiment of the present invention is described with reference to FIGS. 1 to 11. A connector of this embodiment includes a female first housing 10 and a male second housing 60. The first and second housings 10, 60 are connected by being brought closer to each other with the front surfaces thereof caused to face each other. The second housing 60 includes a receptacle 61 extending forward.

The first housing 10 is configured by assembling a housing main body 11 made of synthetic resin and a tubular member 20 likewise made of synthetic resin. The housing main body 11 is configured by integrally forming a block-like terminal accommodating portion 12 and a tubular fitting 13 surrounding the terminal accommodating portion 12. The tubular fitting 13 is connected to the outer periphery of the terminal accommodating portion 12 on a rear end part thereof. A tubular space between the outer periphery of the terminal accommodating portion 12 and the inner periphery of the tubular fitting 13 is open on the front surface of the first housing 10 and serves as a connection space 14 into which the receptacle 61 to be described later is to be fitted.

A plurality of terminal accommodating chambers 15 are formed in the terminal accommodating portion 12, and female terminal fittings 40 (terminal fitting defined in claims) are inserted into the respective terminal accommodating chambers 15 from behind. The inserted female terminal fitting 40 is retained by a locking action of a locking lance 16 formed along an inner wall of the terminal accommodating chamber 15. A recessed receiving portion 17 is formed on the upper surface facing the connection space 14 out of the outer surface of the terminal accommodating portion 12. Further, in the connection space 14, a seal ring 50 is mounted by being fit externally on a rear end part of the outer periphery of the terminal accommodating portion 12.

The tubular member 20 is configured by integrally forming a front wall 21 and a peripheral wall 22 cantilevered back from the outer peripheral edge of the front wall 21. The tubular member 20 is assembled with the housing main body 11 from the front. In an assembled state, the front wall 21 covers the front end surface of the terminal accommodating portion 12 and the peripheral wall 22 surrounds the terminal accommodating portion 12. An assembled area of the tubular member 20 on the outer surface of the terminal accommodating portion 12 extends up to a range before a mounted area of the seal ring 50. Thus, the tubular member 20 functions as a stopper for preventing forward detachment of the seal ring 50 from the terminal accommodating portion 12.

Further, the front wall 21 is formed with deflection regulating portions 23 cantilevered back (inwardly of the peripheral wall 22). The deflection regulating portions 23 regulate the locking lances 16 from being resiliently deformed in a direction to be disengaged from the female terminal fittings 40 by entering deflection spaces for the locking lances 16. Thus, the tubular member 20 also has a function of reliably retaining the female terminal fittings 40 in cooperation with the locking lances 16.

The peripheral wall 22 is formed with a resilient lock 24 as a means for locking the tubular member 20 in a state assembled with the terminal accommodating portion 12. A formation position of the resilient lock 24 in a circumferential direction is a position corresponding to the receiving portion 17 of the housing main body 11, i.e. an upper wall portion 25 of the peripheral wall 22. A front cut portion 26 formed by removing a front end part of the upper wall portion 25 and a rear cut portion 27 formed by removing a rear end part of the upper wall portion 25 are formed in a widthwise central part of the upper wall portion 25. A part of the upper wall portion 25 between the front and rear cut portions 26, 27 left without being removed serves as the resilient lock 24.

The resilient lock 24 is resiliently deflectable in a vertical direction (i.e. direction intersecting with an assembling direction of the tubular member 20 with the housing main body 11) with a support 29 in a front area thereof substantially as a center. Thus, when the resilient lock 24 is deflected resiliently, a displacement amount of the resilient lock 24 is maximized on a rear end part. When the resilient lock 24 is in a free state without being resiliently deflected, the outer surface (upper surface) of the support 29 is parallel to the assembling direction of the tubular member 20 with the housing main body 11 (front-back direction). When the resilient lock 24 is deflected resiliently up (toward the outer surface of the peripheral wall 22), the outer surface of the support 29 is inclined up toward the back and the rear end part of the resilient lock 24 becomes highest.

The rear end part of the resilient lock 24 is formed with a locking projection 30 projecting inward of the peripheral wall 22 from the inner surface (lower surface) thereof. A formation area of the locking projection 30 in the front-back direction is behind the support 29. The support 29 of the resilient lock 24 is formed with a protrusion 31 projecting up from the outer surface thereof. A formation area of the protrusion 31 in the front-back direction is a range before the locking projection 30. In a state where the resilient lock 24 is not resiliently deflected, the upper surface (surface facing the receptacle 61) of the protrusion 31 is parallel to the assembling direction of the tubular member 20 and the housing main body 11 and a connecting direction of the first and second housings 10, 60. Further, the front surface of the protrusion 31 serves as a guiding surface 32 inclined with respect to the front-back direction.

Figure 2:
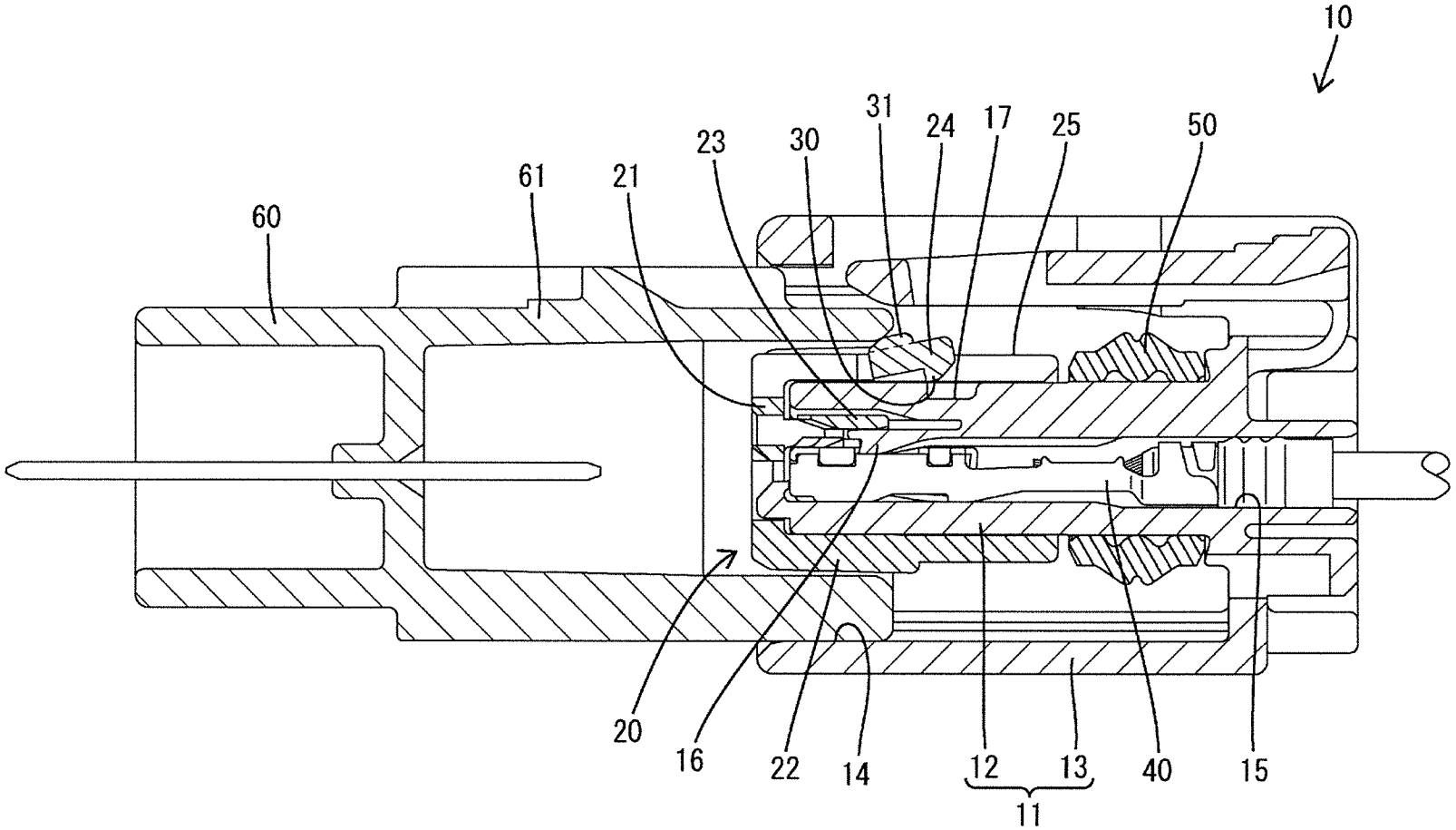
FIG. 2 is a section showing the process of connecting the first and second housings with a tubular member and a housing main body left improperly assembled.
Figure 3:
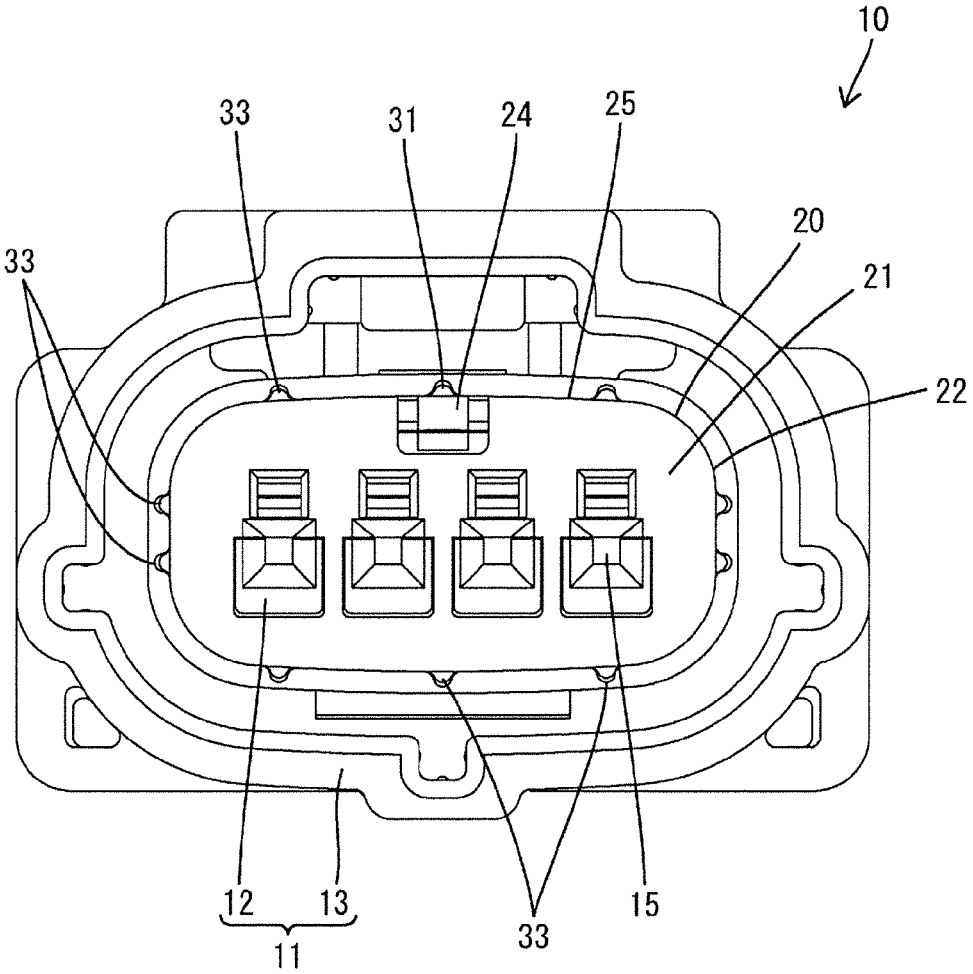
FIG. 3 is a front view of the first housing.
Figure 4:
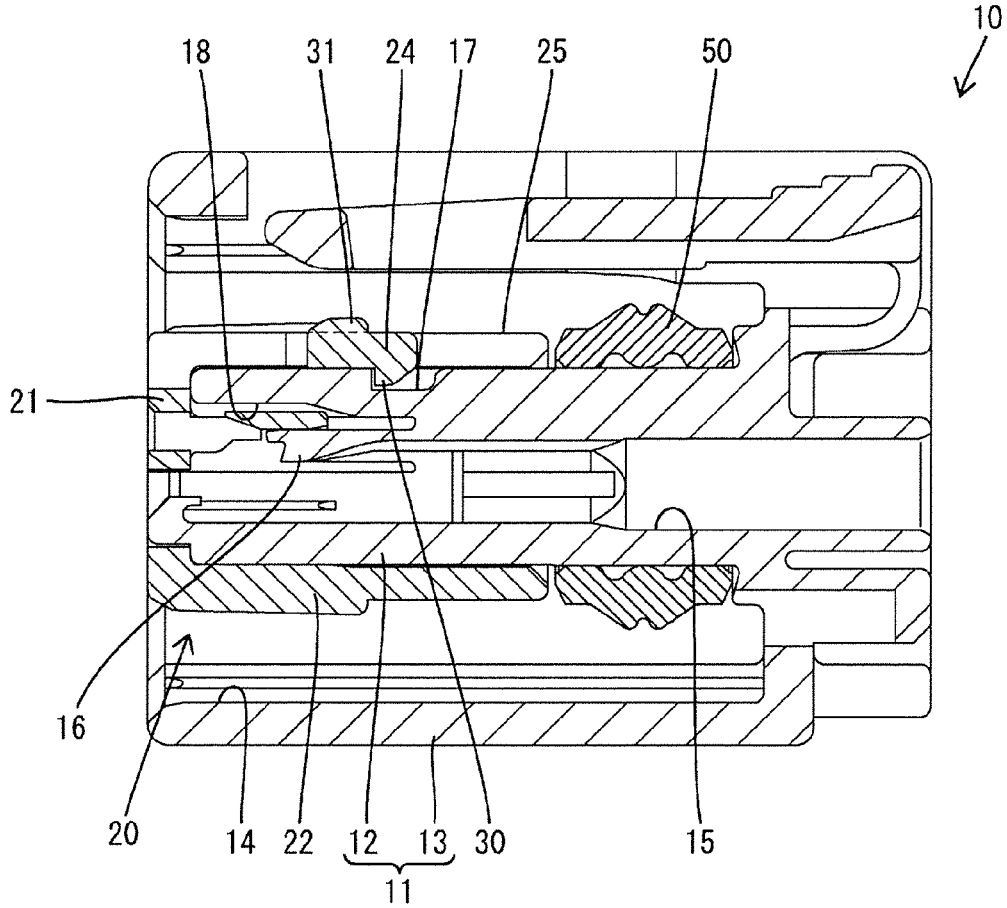
FIG. 4 is a section of the first housing.
Figure 5:
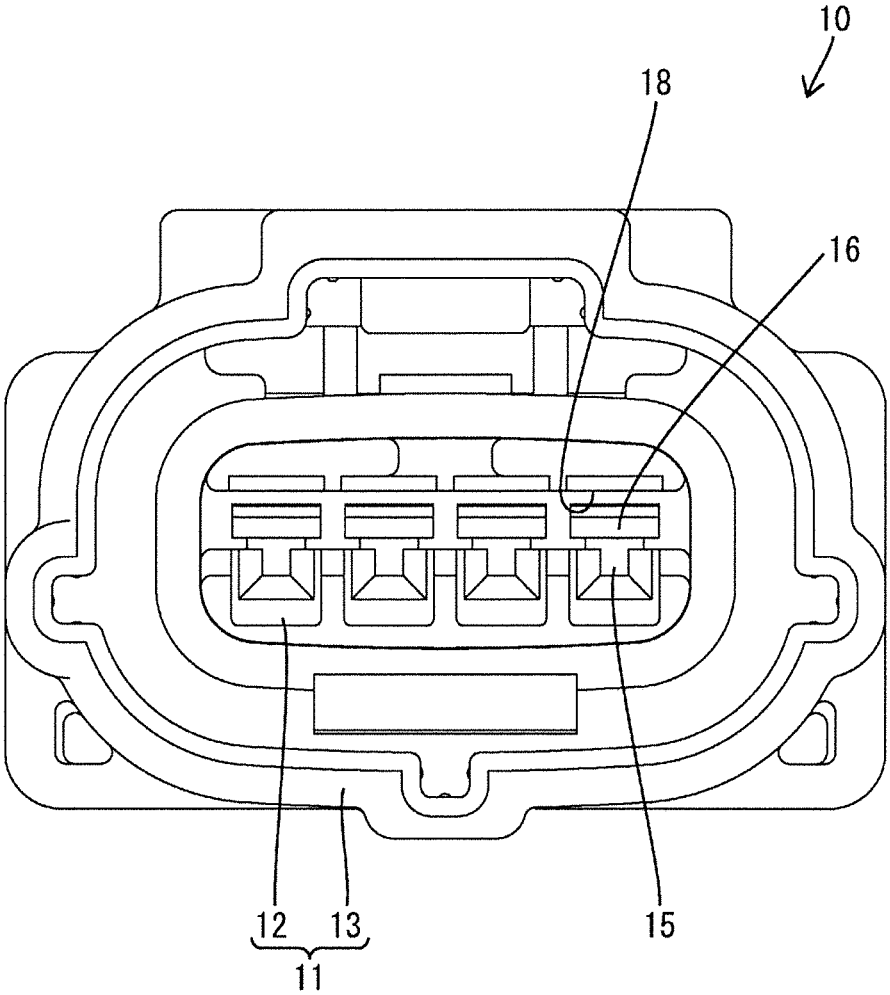
FIG. 5 is a front view of the housing main body.
Figure 6:
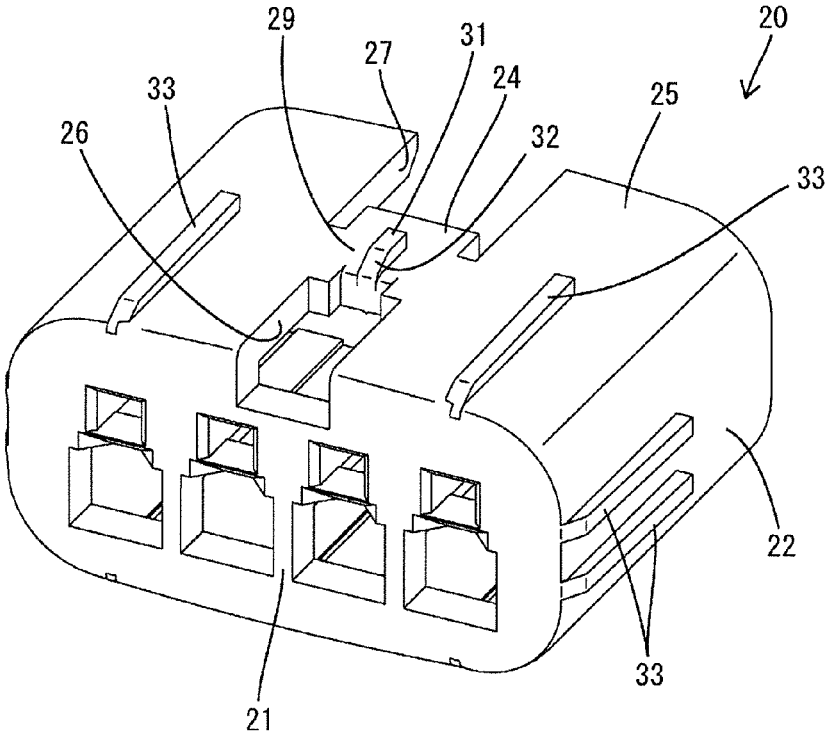
FIG. 6 is a perspective view of the tubular member.
Figure 7:
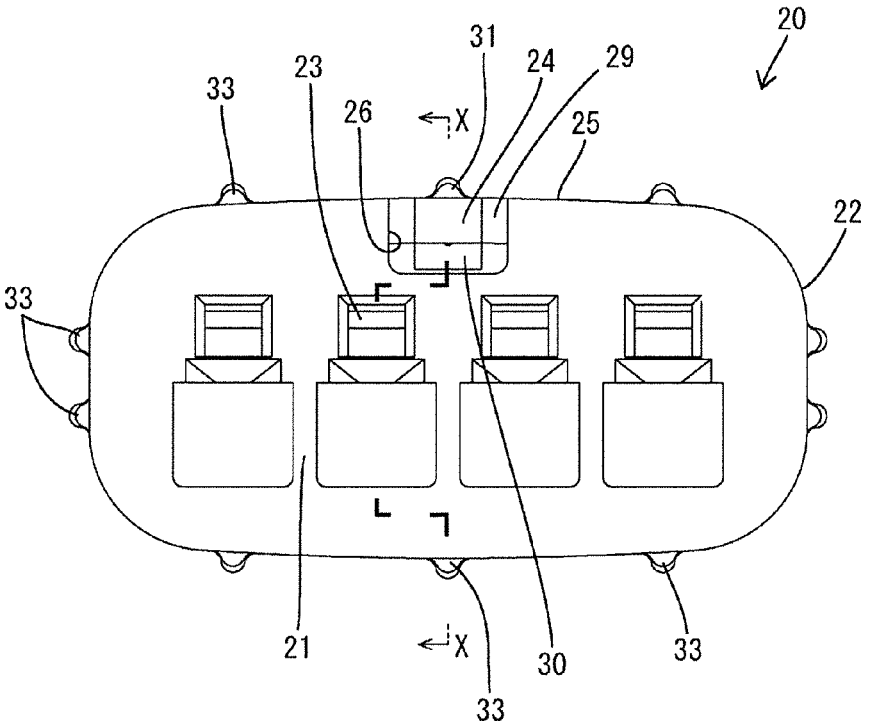
FIG. 7 is a front view of the tubular member.
Figure 8:
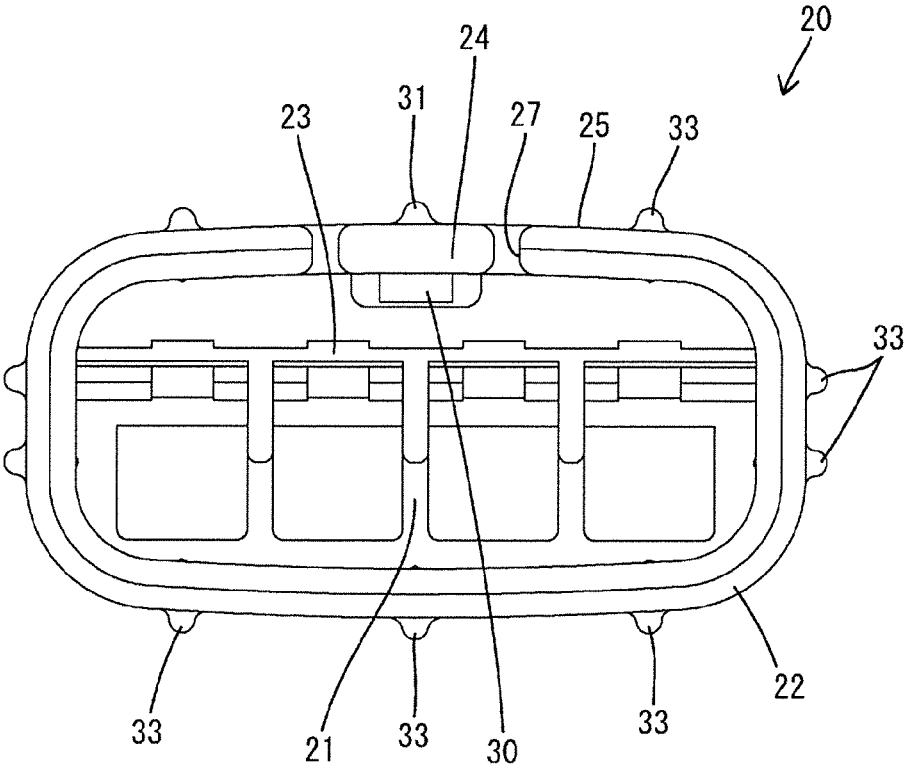
FIG. 8 is a rear view of the tubular member.
Figure 9:
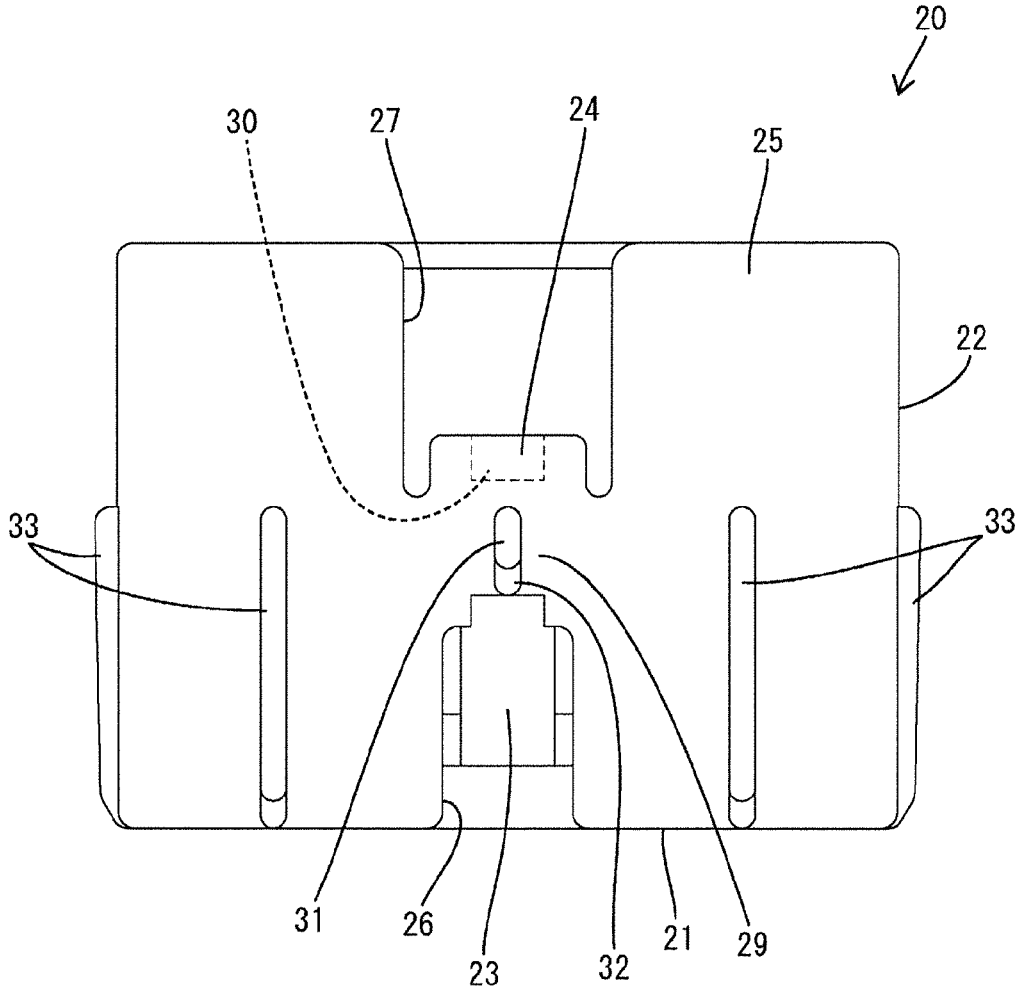
FIG. 9 is a plan view of the tubular member.
Figure 10:
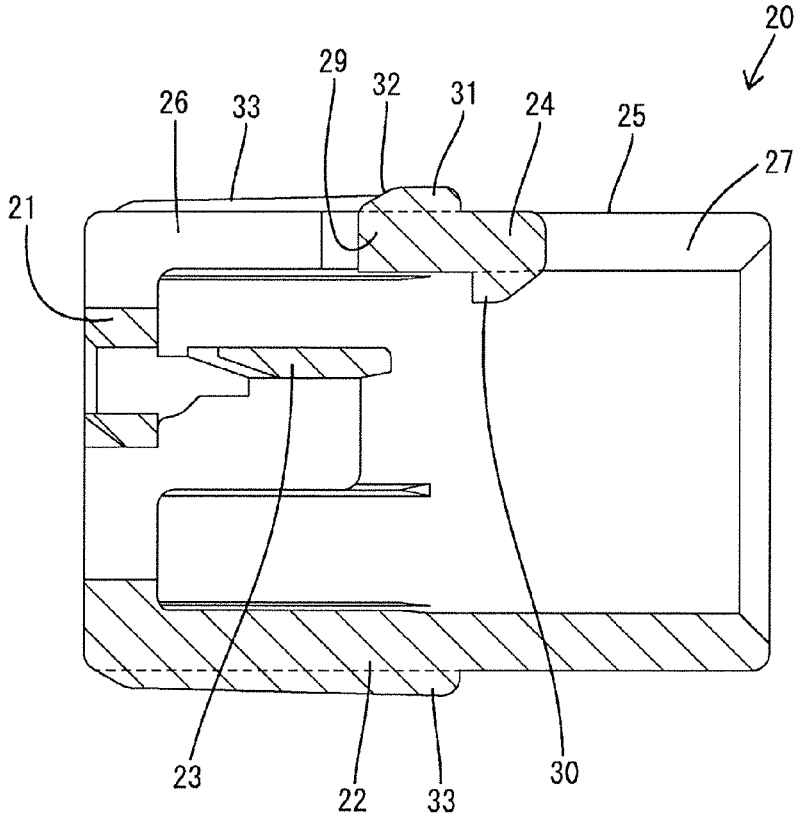
FIG. 10 is a section along X-X of FIG. 7.
Figure 11:
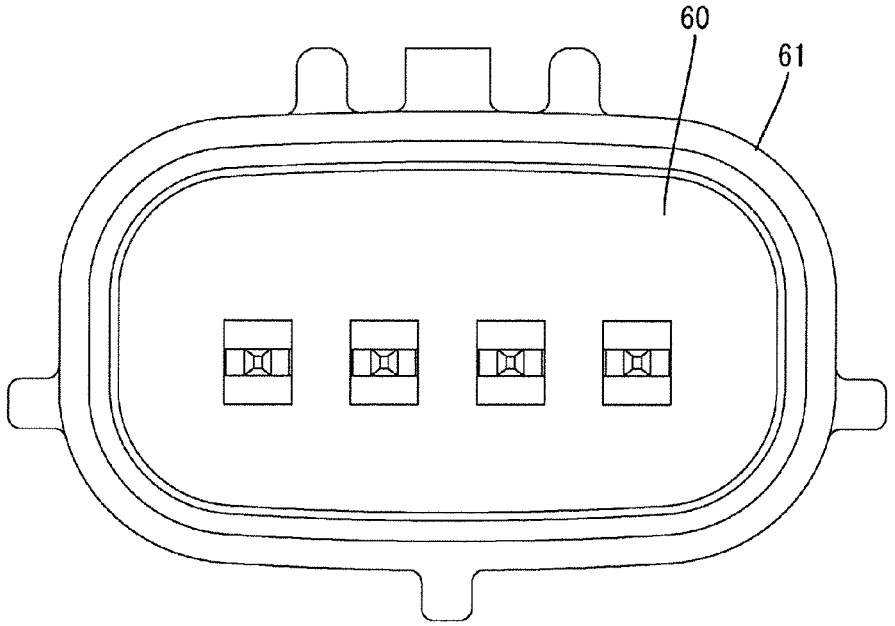
FIG. 11 is a front view of the second housing.

Next, functions of this embodiment are described. In the first housing 10, before connection to the second housing 60, the female terminal fittings 40 are accommodated into the terminal accommodating portion 12 and, thereafter, the tubular member 20 is assembled with the housing main body 11. As shown in FIG. 2, in the process of assembling the tubular member 20 with the housing main body 11 (i.e. in a state where the assembling of the tubular member 20 and the housing main body 22 is improper), the locking projection 30 interferes with the upper surface of the terminal accommodating portion 12, and causes the resilient lock 24 to be deflected resiliently up. At this time, a part of the resilient lock 24, including the protrusion 31, projects farther up than the outer surface of the upper wall portion 25 (peripheral wall 22).

When the tubular member 20 is assembled properly with the housing main body 11, the resilient lock 24 resiliently returns toward the inner peripheral side (down) and the locking projection 30 is locked to the receiving portion 17. By this locking action, the tubular member 20 and the housing main body 11 are locked in a properly assembled state. Further, when the tubular member 20 is assembled with the housing main body 11, the deflection regulating portions 23 enter the deflections spaces 18 to regulate the disengagement of the locking lances 16 from the female terminal fittings 40. If the female terminal fitting 40 is inserted improperly, the deflection regulating portion 23 collides with the locking lance 16 resiliently displaced into the deflection space 18. Therefore an insertion failure of the female terminal fitting 40 can be detected.

After the tubular member 20 is assembled with the housing main body 11, the terminal accommodating portion 12 and the tubular member 20 are inserted into the receptacle 61 and the tubular fitting 13 is fit externally on the receptacle 61, thereby connecting the two housings 10, 60. In a connection process, the upper surface of the protrusion 31 slides in surface contact with the inner periphery of the receptacle 61 while being pressed. Further, even in a state where the connection is completed, the upper surface of the protrusion 31 is in surface contact with the inner periphery of the receptacle 61 while being pressed. By this contact of the protrusion 31 in the pressed state, a backlash preventing function is exhibited and relative displacements of the two housings 10, 60 in the vertical and lateral directions intersecting with the connecting direction are regulated.

Further, in a state where backlash is prevented by the protrusion 31, an area of the inner surface of the resilient lock 24 where the protrusion 31 is formed (inner surface of the support 29) is in contact with the outer periphery of the terminal accommodating portion 12. This causes the resilient lock 24 to be sandwiched between the outer surface of the terminal accommodating portion 12 and the inner surface of the receptacle 61 and reliably prevents relative displacements of the two housings 10, 60. Note that ribs 33 extending in the front-back direction are formed at a plurality of circumferentially spaced-apart positions on the outer periphery of the peripheral wall 22. These ribs 33 are in contact with the inner periphery of the receptacle 61 while being pressed in the vertical or lateral direction. These ribs 33 also exhibit the function of preventing backlash between the two housings 10, 60 similarly to the protrusion 31.

Further, if the two housings 10, 60 are connected with the tubular member 20 and the housing main body 11 left improperly assembled, the improperly assembled state is corrected. Specifically, if the tubular member 20 and the housing main body 11 are assembled improperly, the rear end part of the resilient locking portion 24 and the protrusion 31 project from the outer surface (upper surface) of the peripheral wall 22, as shown in FIG. 2. Thus, if it is attempted to fit the terminal accommodating portion 12 and the tubular member 20 into the receptacle 61 in this state, the protrusion 31 interferes with the front end edge of the inner periphery of the receptacle 61.

If the two housings 10, 60 are connected further from this state, the protrusion 31 is pushed back by the receptacle 61. By this pushing action, the tubular member 20 is displaced back relative to the terminal accommodating portion 12. Since the tubular member 20 is assembled with the terminal accommodating portion 12 from the front, it is pushed to a proper assembling position by a relative backward displacement. When the tubular member 20 reaches the proper assembling position with respect to the housing main body 11, the resilient lock 24 resiliently returns and the locking projection 30 is locked to the receiving portion 17, as shown in FIG. 1. In this way, the tubular member 20 and the housing main body 11 are locked in the properly assembled state.

In the connector of this embodiment, the peripheral wall 22 constituting the tubular member 20 is formed with the resilient lock 24. The resilient lock 24 is deflected resiliently to project toward the outer peripheral side of the peripheral wall 22 by interfering with the outer periphery of the housing main body 11 in the process of assembling the tubular member 20 with the housing main body 11. Further, the resilient lock 24 resiliently returns toward the inner peripheral side to be locked to the receiving portion 17 when the tubular member 20 is assembled properly with the housing main body 11. The outer periphery of the resilient lock 24 is formed with the protrusion 31 for correcting the tubular member 20 into the properly assembled state by interfering with the receptacle 61 in the process of fitting the tubular member 20 and the housing main body 11 left in the improperly assembled state into the receptacle 61.

According to this configuration, in the process of fitting the tubular member 20 and the housing main body 11 left in the improperly assembled state into the receptacle 61, the protrusion 31 on the outer periphery of the resilient lock 24 interferes with the receptacle 61 to correct the position of the tubular member 20 and attain the properly assembled state. Thus, the connection of the two housings 10, 60 with the tubular member 20 and the housing main body 11 left in the improperly assembled state can be avoided.

Further, in the connector of this embodiment, the protrusion 31 is in contact with the inner periphery of the receptacle 61 while being pressed with the properly assembled housing main body 11 and the tubular member 20 fitted in the receptacle 61. This contact action regulates relative displacements of the two housings 10, 60. That is, the protrusion 31 for correcting improper assembling of the tubular member 20 and the housing main body 11 also functions as a backlash preventing means for regulating relative displacements of the two housings 10, 60. Thus, the shape of the first housing 10 can be simplified in this embodiment as compared to the case where a dedicated backlash preventing means for regulating relative displacements of the two housings 10, 60 is provided in addition to the protrusion 31.

Further, with the properly assembled housing main body 11 and tubular member 20 fitted in the receptacle 61, the facing surface (upper surface) of the protrusion 31 facing the receptacle 61 is in surface contact with the inner periphery of the receptacle 61. Thus, improper deformation of the protrusion 31 and the receptacle 61 can be avoided. Further, the resilient locking portion 24 is resiliently deflectable with the support 29 substantially as a center and the protrusion 31 is formed on the support 29. According to this configuration, the position of the protrusion 31 is unlikely to vary since the protrusion 31 is arranged on the support 29 that is hard to deform. Therefore, the reliability of a position correcting function by the protrusion 31 is excellent.

The present invention is not limited to the above described and illustrated embodiment. For example, the following embodiments are also included in the technical scope of the present invention.

The formation area of the protrusion out of the inner surface of the resilient lock is held in contact with the outer periphery of the housing main body with the first and second housings connected in the above embodiment. However, an area of the inner surface of the resilient lock to be held in contact with the outer periphery of the housing main body may be set in a range not corresponding to the formation area of the protrusion.

Although the protrusion also functions as the backlash preventing means for regulating relative displacements of the first and second housings in the above embodiment, the protrusion may not function as the backlash preventing means.

The protrusion is arranged in the area of the resilient lock that functions as a support of resilient deflection in the above embodiment. However, the protrusion may be formed in an area of the resilient locking portion deviated from the support of resilient deflection, i.e. in a resiliently deformable area.

LIST OF REFERENCE SIGNS

10 . . . first housing
11 . . . housing main body

17 . . . receiving portion
20 . . . tubular member
22 . . . peripheral wall
24 . . . resilient lock
31 . . . protrusion
40 . . . female terminal fitting (terminal fitting)
60 . . . second housing
61 . . . receptacle

The invention claimed is:

1. A connector, comprising:

a female first housing that includes:

a housing main body having a terminal accommodating portion with opposite front and rear ends and configured to accommodate a terminal fitting, the terminal accommodating portion having an outer periphery formed with a recessed receiving portion; and a tubular member having a peripheral wall configured to be assembled to surround the terminal accommodating portion of the housing main body, the peripheral wall including a resilient lock with a locking projection projecting in and configured to interfere with the outer periphery of the terminal accommodating portion of the housing main body and to deflect resiliently out when the tubular member is being assembled to the terminal accommodating portion of the housing main body and the resilient lock returning resiliently so that the locking projection locks with the recessed receiving portion when the tubular member is assembled properly to the terminal accommodating portion of the housing main body;

a male second housing having a receptacle configured to fit and surround the tubular member that is assembled to the terminal accommodating portion of the housing main body; and a protrusion formed on an outer periphery of the resilient lock and configured to interfere with a front end of receptacle when fitting the tubular member and the terminal accommodating portion of the housing main body into the receptacle, if the tubular member is left in an improperly assembled state on the terminal accommodating portion of the housing main body so that the front end of the receptacle pushes the protrusion rearward on the terminal accommodating portion and into a position where the locking projection locks with the recessed receiving portion.

2. The connector of claim 1, wherein the protrusion is in contact with an inner periphery of the receptacle while being pressed with the properly assembled housing main body and tubular member fit in the receptacle, thereby regulating relative displacements of the first and second housings.

3. The connector of claim 2, wherein an area of the resilient lock opposite the protrusion is in contact with the outer periphery of the housing main body when the first and second housings are connected.

4. The connector of claim 3, wherein a facing surface of the protrusion facing the receptacle is in surface contact with the inner periphery of the receptacle when the properly assembled housing main body and tubular member are fit in the receptacle.

5. The connector of claim 4, wherein:

the resilient lock is resiliently deflected about a support; and the protrusion is formed on the support.

6. The connector of claim 2, wherein a facing surface of the protrusion facing the receptacle is in surface contact with the inner periphery of the receptacle when the properly assembled housing main body and tubular member are fit in the receptacle.

7. The connector of claim 1, wherein the tubular member has opposite front and rear ends, a front wall formed at the front end of the tubular member and covers the front end of the terminal accommodating portion.

8. The connector of claim 7, wherein the peripheral wall of the tubular member extends rearward from the front wall to the rear end of the tubular member, a rear cut extending forward in the peripheral wall from the rear end of the tubular member, the peripheral wall including a support forward of and adjacent to the rear cut, the resilient lock projecting rearward from the support into the rear cut.

9. The connector of claim 8, wherein the protrusion is formed on the support of the peripheral wall.

10. The connector of claim 9, wherein the protrusion has a front end that is sloped to project farther from the peripheral wall at more rearward positions on the protrusion to define a pushing surface that can be pushed by the front end of the receptacle.

11. The connector of claim 9, wherein the support defines a portion of the peripheral wall that extends continuously around the terminal accommodating portion.

12. The connector of claim 8, wherein an outer surface of the resilient lock is substantially aligned with the support in an unbiased condition of the resilient lock, and wherein the resilient lock is resiliently deflectable to project outward from the support when the tubular member is being mounted on to the terminal accommodating portion.

13. The connector of claim 1, wherein the resilient lock is spaced from the terminal fitting accommodated in the terminal accommodating portion.

14. The connector of claim 1, wherein the recessed receiving portion has a closed bottom.

15. The connector of claim 1, further comprising a tubular fitting connected to the rear end of the terminal accommodating portion and projecting forward therefrom while being spaced out from the terminal accommodating portion at positions forward of the rear end of the terminal accommodating portion and outward of the resilient lock.

16. The connector of claim 1, wherein the locking projection of the resilient lock engages a surface of the recessed receiving portion to prevent movement of the tubular member in a direction away from the rear end of the terminal accommodating portion.

* * * * *